US008408882B2

(12) United States Patent
Klika et al.

(10) Patent No.: US 8,408,882 B2
(45) **Date of Patent: *Apr. 2, 2013**

(54) PRESSURE WASHER PUMP AND ENGINE SYSTEM

(75) Inventors: Daniel L. Klika, Waukesha, WI (US); David A. Kratz, Brookfield, WI (US)

(73) Assignee: Briggs & Stratton Corporation, Wauwatosa, WI (US)

( * ) Notice: Subject to any disclaimer, the term of this patent is extended or adjusted under 35 U.S.C. 154(b) by 455 days.

This patent is subject to a terminal disclaimer.

(21) Appl. No.: 12/573,818

(22) Filed: Oct. 5, 2009

(65) Prior Publication Data

US 2011/0081260 A1 Apr. 7, 2011

(51) Int. Cl.
*F04B 17/05* (2006.01)
*F01D 5/10* (2006.01)

(52) U.S. Cl. ..... 417/364; 417/367; 123/41.47

(58) Field of Classification Search ..... 417/364, 417/366, 367; 123/41.47
See application file for complete search history.

(56) References Cited

U.S. PATENT DOCUMENTS 2,004,849 A * 6/1935 Bretschger et al. ..... 208/221
2,103,861 A * 12/1937 Melcher ..... 417/364
2,554,191 A 5/1951 Huber
3,525,001 A 8/1970 Erickson
4,086,034 A 4/1978 Hokky
4,140,442 A 2/1979 Mulvey
4,155,333 A 5/1979 Maggiorana
4,198,935 A * 4/1980 Seibt et al. ..... 123/41.44
4,480,967 A 11/1984 Schulze
4,583,921 A 4/1986 Wolff et al.
4,643,652 A 2/1987 Eberhardt
4,756,280 A * 7/1988 Tamba et al. ..... 123/41.47
5,040,950 A 8/1991 Dalquist, III et al.
5,179,921 A * 1/1993 Figliuzzi ..... 123/198 C
5,338,162 A 8/1994 Krarup
5,415,134 A 5/1995 Stewart, Jr.
5,494,414 A * 2/1996 Steinhart et al. ..... 417/360
5,556,264 A 9/1996 Simonette
5,785,505 A 7/1998 Price
5,975,863 A 11/1999 Mazzucato
5,980,220 A * 11/1999 Mazzucato et al. ..... 417/360
6,092,998 A 7/2000 Dexter et al.
6,109,221 A 8/2000 Higgins et al.
6,146,222 A 11/2000 Murata et al.

(Continued)

OTHER PUBLICATIONS

Honda Marine, BF 35A/40A/50A Owner's Manual, 1994, American Honda Motor Co., Inc., 111 pages.

(Continued)

*Primary Examiner* — Charles Freay
(74) *Attorney, Agent, or Firm* — Foley & Lardner LLP

(57) ABSTRACT

A pressure washer system includes an internal combustion engine and a water pump. The internal combustion engine includes an engine block forming a chamber and a cover for the chamber. The cover has an area designed to hold a lubricant. Additionally, the engine includes a crankshaft within the chamber. The water pump includes a pumping mechanism, an inlet, an outlet, and a fluid passage. The pumping mechanism is powered by the crankshaft. Water enters the pump through the inlet and exits the pump through the outlet. The fluid passage extends between the inlet and the outlet. A portion of the fluid passage is formed in the cover of the engine. Heat transfers from the lubricant of the engine to the water of the water pump during operation of the pressure washer system.

36 Claims, 15 Drawing Sheets

U.S. PATENT DOCUMENTS

| | | | | |
|---|---|---|---|---|
| 6,270,322 | B1 | 8/2001 | Hoyt | |
| 6,886,523 | B2 * | 5/2005 | Steffes et al. | 123/196 R |
| 2006/0102212 | A1 | 5/2006 | Leasure et al. | |
| 2006/0254539 | A1 * | 11/2006 | Emmersberger | 123/41.47 |
| 2011/0081260 | A1 | 4/2011 | Klika et al. | |

OTHER PUBLICATIONS

Honda Marine, Flush Kits, 06190-881-860, 06190-ZV1-860, 19270-SW1-740, 1 page.

* cited by examiner

PRESSURE WASHER PUMP AND ENGINE SYSTEM

BACKGROUND

The present invention relates generally to the field of pressure washers. More specifically, the present invention relates to a pressure washer water pump and a crankcase of a small engine used to power the pump.

A pressure washer includes a water pump powered by a small, internal combustion engine. The engine includes an engine block having internal chamber, such as a crankcase, in which a piston drives a crankshaft. The piston and crankshaft are lubricated by motor oil, and if the engine is a vertically-shafted engine, typically the oil pools in a cover (e.g., a sump) forming a base of the crankcase. The engine may be mounted to a base plate of a wheeled support frame. A power takeoff end of the crankshaft extends through an opening in the crankcase, and then through the base plate to engage the water pump.

The water pump typically includes a housing mounted to the underside of the base plate. Typically inlet and outlet pipes extend from the water pump beneath the base plate. To use the pressure washer, a garden hose is attached to the inlet pipe, and a pressure washer spray gun is coupled to a high-pressure hose line attached to the outlet pipe of the pump. Within the housing, the pump includes a pumping mechanism for driving the flow of water.

SUMMARY

One embodiment of the invention relates to a pressure washer system that includes an internal combustion engine and a water pump. The internal combustion engine includes an engine block forming a chamber in the engine block, and a cover for the chamber. The cover has an area designed to hold a lubricant. Additionally, the engine includes a crankshaft within the chamber. The water pump includes a pumping mechanism, an inlet, an outlet, and a fluid passage. The pumping mechanism is powered by the crankshaft. Water enters the pump through the inlet and exits the pump through the outlet. The fluid passage extends between the inlet and the outlet. A portion of the fluid passage is formed in the cover of the engine. Heat transfers from the lubricant of the engine to the water of the water pump during operation of the pressure washer system.

Another embodiment of the invention relates to a pressure washer system that includes an internal combustion engine and a water pump. The engine includes an engine block that forms a chamber, and a cover for the chamber. The cover includes an area designed to hold a lubricant. The engine also includes a crankshaft within the chamber. The water pump includes a pumping mechanism, an inlet, an outlet, a first conduit, and a second conduit. The pumping mechanism is powered by the crankshaft. Water enters the pump through the inlet and exits the pump through the outlet. The first conduit extends between the inlet and the pumping mechanism. The second conduit extends between the pumping mechanism and the outlet. The first conduit of the water pump is formed in the cover.

Yet another embodiment of the invention relates to a pressure washer system. The pressure washer system includes an engine, a water pump, and a spray gun. The engine has a crankcase and a cover for the crankcase. The cover is designed to hold a pool of oil for lubricating the engine. The water pump is powered by the engine, and has an inlet, an outlet, and at least one fluid passage between the inlet and the outlet. The spray gun is designed to be attached to the outlet with a hose. A portion of the at least one fluid passage of the water pump is integrally formed with and extends through the cover of the engine.

Still another embodiment of the invention relates to a pump and engine system. The system includes an internal combustion engine and a water pump. The engine has a sump designed to hold lubricant. The water pump includes a pumping mechanism, an inlet conduit, and an outlet conduit. The pumping mechanism is powered by the engine. The inlet conduit is designed to direct water into the pumping mechanism. The outlet conduit is designed to direct water away from the pumping mechanism. The sump of the engine and the inlet conduit of the water pump are integrally formed.

Alternative exemplary embodiments relate to other features and combinations of features as may be generally recited in the claims.

BRIEF DESCRIPTION OF THE FIGURES

The disclosure will become more fully understood from the following detailed description, taken in conjunction with the accompanying figures, wherein like reference numerals refer to like elements, in which.

DETAILED DESCRIPTION OF THE EXEMPLARY EMBODIMENTS

Before turning to the figures, which illustrate the exemplary embodiments in detail, it should be understood that the present application is not limited to the details or methodology set forth in the description or illustrated in the figures. It should also be understood that the terminology is for the purpose of description only and should not be regarded as limiting.

Figure 1:
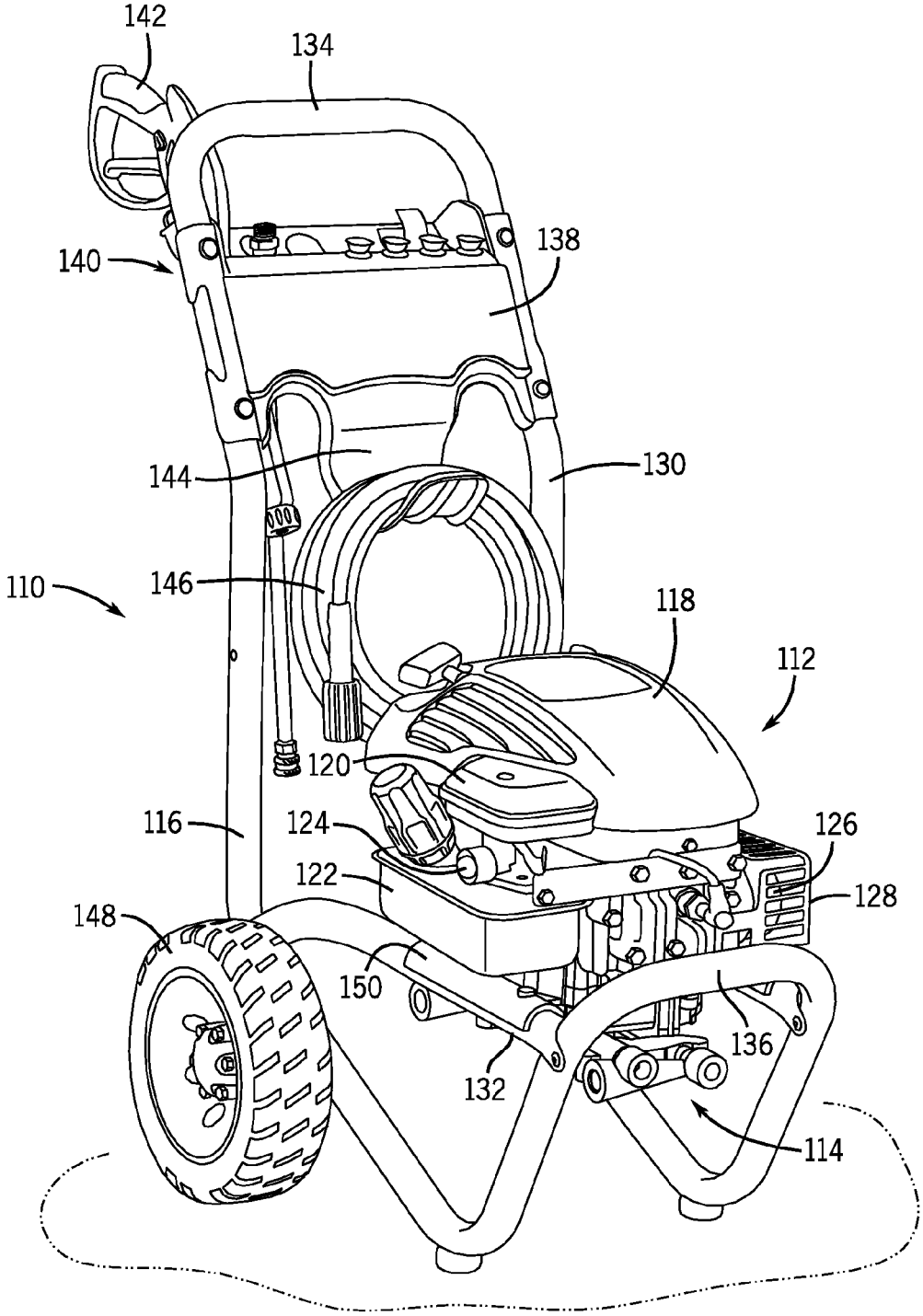
FIG. 1 is a perspective view of a pressure washer system according to an exemplary embodiment of the invention.

Referring to FIG. 1, a pressure washer system 110 includes an internal combustion engine 112, a high-pressure water pump 114, and a support frame 116. The engine includes an engine cover 118, an air intake 120, a fuel tank 122, a priming bulb 124, a muffler 126 surrounded by a cage 128, and other engine components. The engine 112 further includes a mounting structure in the form of attachment supports 150 (e.g., wings, sleeves, saddles, brackets, etc.) that extend from the engine. According to an exemplary embodiment, the engine 112 is a four cycle (four cycle meaning four piston strokes per cycle), vertically shafted, single-cylinder engine of a portable size and weight, and with a power sufficient to drive the high-pressure water pump 114. In some embodiments, the engine 112 is configured to provide 3 to 10 foot-pounds (ft-lbf) of torque at a rate of 3060 revolutions per minute (rpm). In another embodiment, the engine is configured to provide a power of 3 to 50 horsepower (HP). In other embodiments, the engine 112 may be a two-stroke engine, or may be horizontally shafted, or has more than one cylinder, or is diesel powered.

Figure 14:
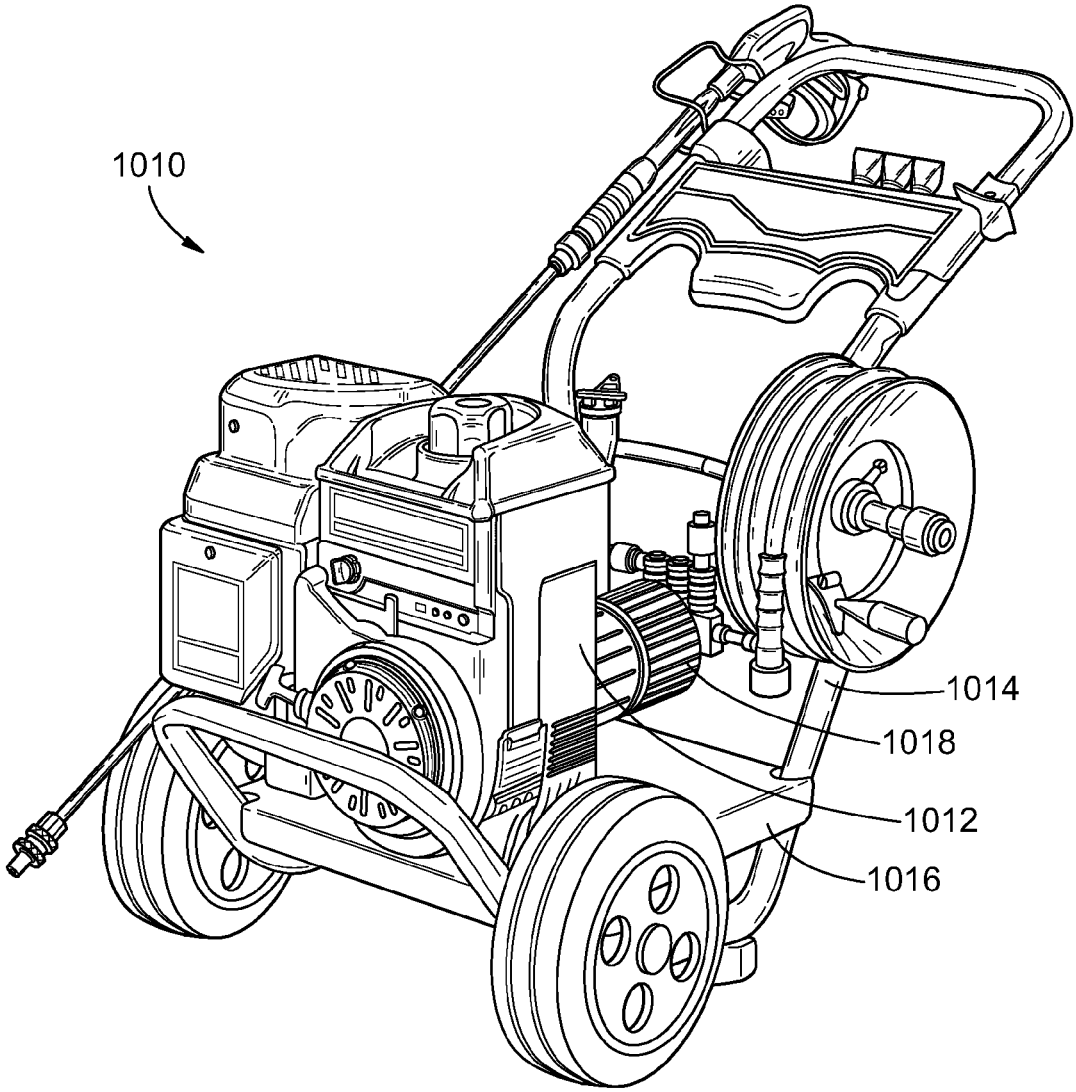
FIG. 14 is a perspective view of a pressure washer system according to another exemplary embodiment of the invention.
Figure 15:
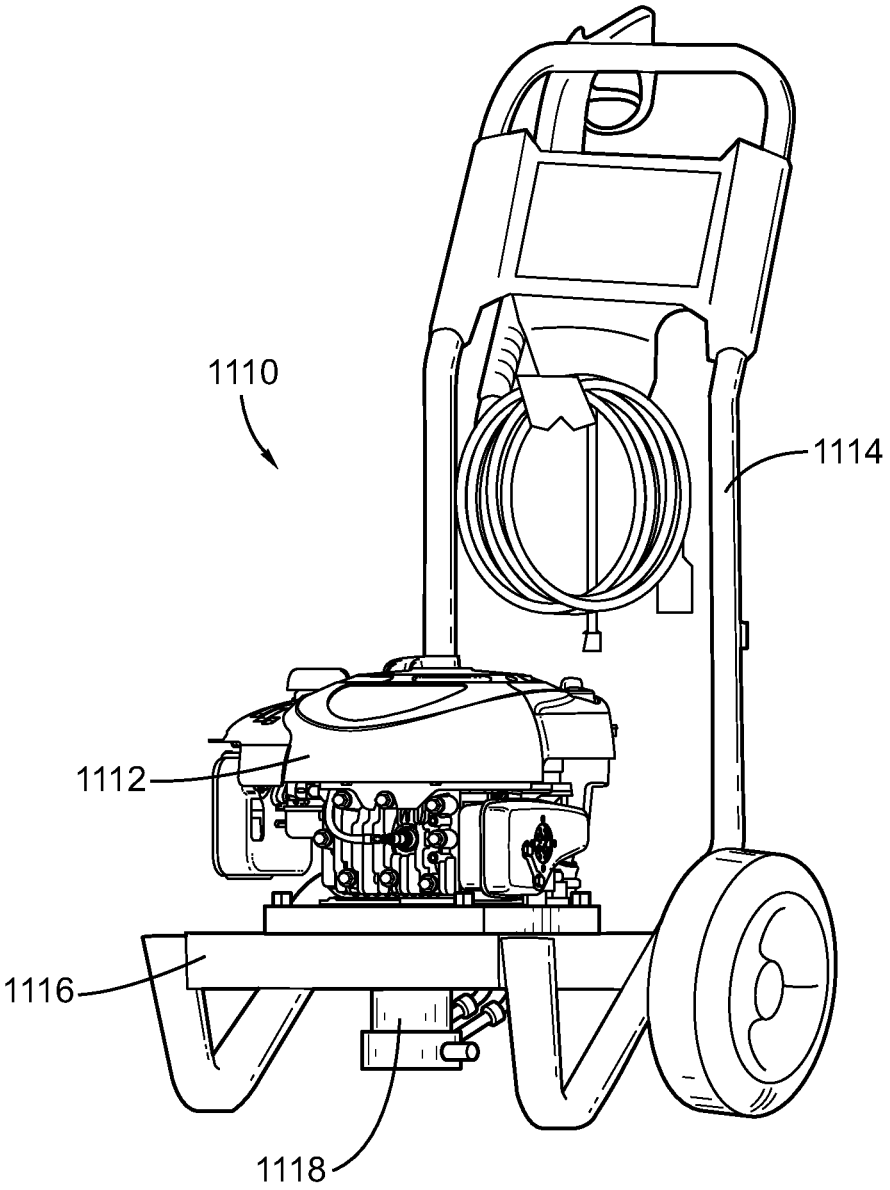
FIG. 15 is a perspective view of a pressure washer system according to yet another exemplary embodiment of the invention.

The engine 112 and the pump 114 are mounted on the support frame 116, which is formed from a network of tubular beams 130 with two beams 132 (e.g., rails, bars, tracks, etc.) upon which the engine 112 is fastened. The support frame additionally includes a handle 134, a front member 136, a billboard 138, a holster 140 for a pressure washer spray gun 142, a rack 144 for a high-pressure hose 146, wheels 148, and other features. The attachment supports 150 of the engine 112 are positioned on the beams 132 and are bolted or otherwise fastened to the frame 116. In other embodiments, a base plate is used in place of attachment supports 150 (see, e.g., base plate 1016 as shown in FIG. 14, and base plate 1116 as shown in FIG. 15). In still other embodiments, the support frame 116 includes casters, a protective housing or framework surrounding the engine 112, a drive system for powering the wheels 148, and other features.

Figure 2:
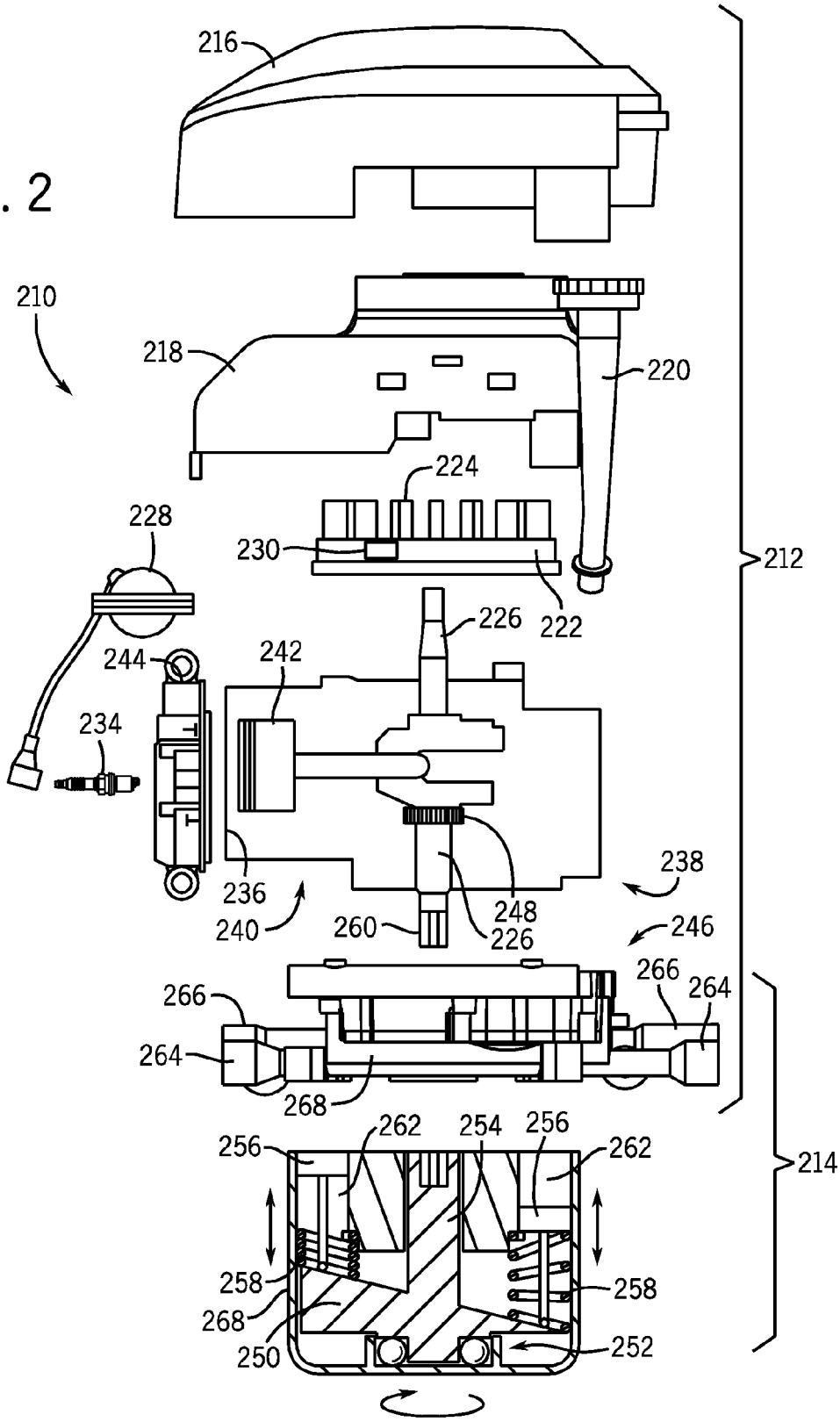
FIG. 2 is an exploded view of an engine and a water pump according to an exemplary embodiment of the invention.
Figure 3:
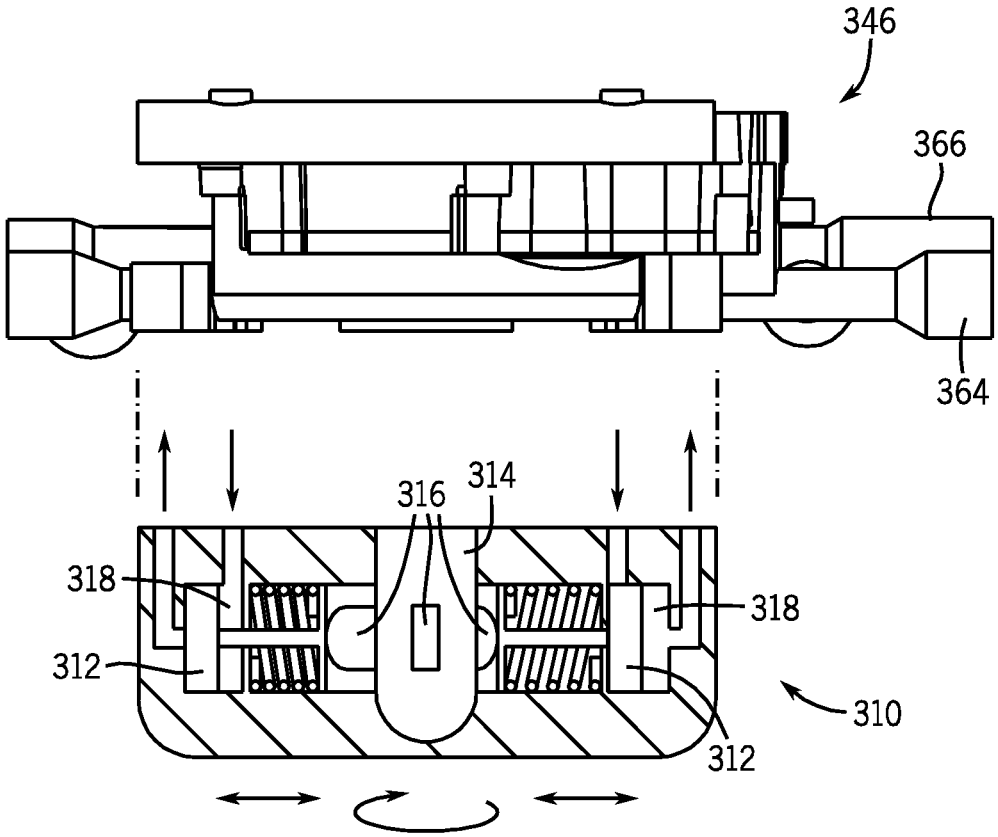
FIG. 3 is an exploded view of a portion of an engine and a water pump according to an exemplary embodiment of the invention.
Figure 4:
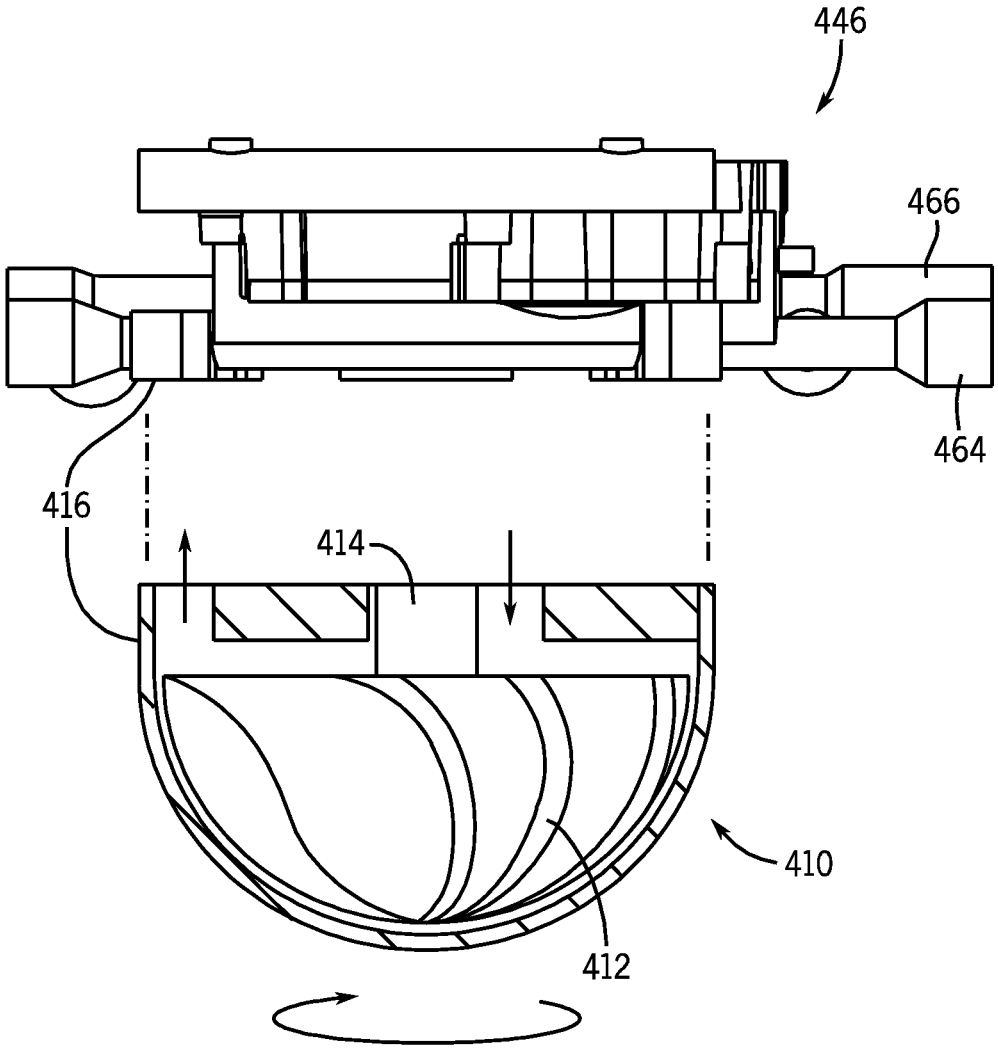
FIG. 4 is an exploded view of a portion of an engine and a water pump according to another exemplary embodiment of the invention.

The high-pressure water pump 114 may be a positive displacement pump, such as an axial cam pump (see, e.g., pump 214 as shown in FIG. 2), a duplex water pump with two pistons or plungers (see, e.g., pump 310 as shown in FIG. 3), a triplex water pump, a radial pump, or another type of positive displacement pump according to various embodiments. In operation, a high-pressure water stream is generated by the pump 114 and exits the pressure washer system 110 through the spray gun 142, or another form of sprayer. In some embodiments the pressure washer system is configured to generate a water stream having an exit pressure exceeding 1000 psi, preferably exceeding 2000 psi. In other embodiments, the water pump 114 is not a positive displacement pump. For example, in at least one embodiment, the pump 114 is a centrifugal water pump (see, e.g., pump 410 as shown in FIG. 4). In another embodiment, the pump 114 is an oil-less pump (e.g., similar to a pump disclosed in U.S. Pat. No. 6,397,729).

Referring to FIG. 2, a pressure washer system 210 includes an engine 212 and a pump 214. The engine 212 is assembled from several components, including a shroud 216 mounted over a blower housing 218 and an oil fill tube 220. Beneath the blower housing 218, the engine 212 includes a flywheel 222 with blower fan blades 224 extending from the flywheel 222. A crankshaft 226 rotates the flywheel 222, which stores rotational inertia and, via the blower fan blades 224, also generates an air flow to cool the engine 212. Additionally, an ignition armature 228 is mounted proximate to the flywheel 222 so that magnets 230 within the flywheel 222 pass by the ignition armature 228 at specifically timed intervals, generating a high-voltage charge once per rotation of the flywheel 222. The charge is directed to a sparkplug 234, which sparks to ignite a fuel and air mixture in a combustion chamber 236 of the engine 212.

Still referring to FIG. 2, the crankshaft 226 extends within a crankcase 238 (e.g., a chamber formed in a block of the engine). A cylinder 240 extends from the side of the crankcase 238, through which a piston 242 translates. A cylinder head 244 is mounted to an end of the cylinder 240, enclosing the combustion chamber 236. The piston 242 is driven by the specifically timed ignitions of fuel/air mixture in the combustion chamber 236 initiated by the sparkplug 234. Additionally, a cover 246 (e.g., a crankcase sump) is attached to the bottom of the crankcase 238. Oil (or other lubricant) forms a pool in the cover 246 and is then spread throughout the crankcase 238 by a dipper, a slinger, or some other distribution device (not shown), which may be powered by the crankshaft 226. The crankshaft 226 includes gearing 248 that drives a camshaft (not shown) and other components of the engine 212.

Beneath the crankcase 238, the pump 214 is coupled to the engine 212 and includes a wobble plate 250, a bearing 252, a shaft 254, pistons 256, and springs 258 for biasing the pistons 256. A power takeoff 260, extending from the crankshaft 226, is coupled to the shaft 254 of the pump 214. The wobble plate 250 of the pump 214 is positioned below the pistons 256, in an inverted axial cam configuration. As the shaft 254 rotates, the wobble plate 250 drives the pistons 256. Each of the pistons 256 pulls water into a chamber 262 from an inlet conduit 264 (e.g., a first conduit, fluid passage, etc.) and then pushes the water, under pressure, from the chamber 262 to an outlet conduit 266 (e.g., a second conduit, fluid passage, etc.). The pistons 256 have a two-stroke cycle (i.e., intake on a downward stroke, and exit on an upward stroke). Check valves allow the water to pass by the pistons 256 on each downward stroke.

According to an exemplary embodiment, the cover 246 of the engine 212 is integrally formed with a part of a housing 268 of the pump 214. The underside of the cover 246 forms a top of the housing 268. The crankshaft 226 passes through an opening in cover 246 to drive the pump 214. In some embodiments, fluid passages, such as the inlet and outlet conduits 264, 266 of the pump 214, extend within the cover 246 and through the housing 268. In certain embodiments, the inlet and outlet conduits 264, 266 are integrally formed with and extend from the cover 246 and housing 268. Extending the inlet and outlet conduits 264, 266 from the top of the pump 214 provides for an elevated access point, which may be more convenient to a user of the system 210 relative to pumps with pipes extending from the bottom of the pumps.

Figure 7:
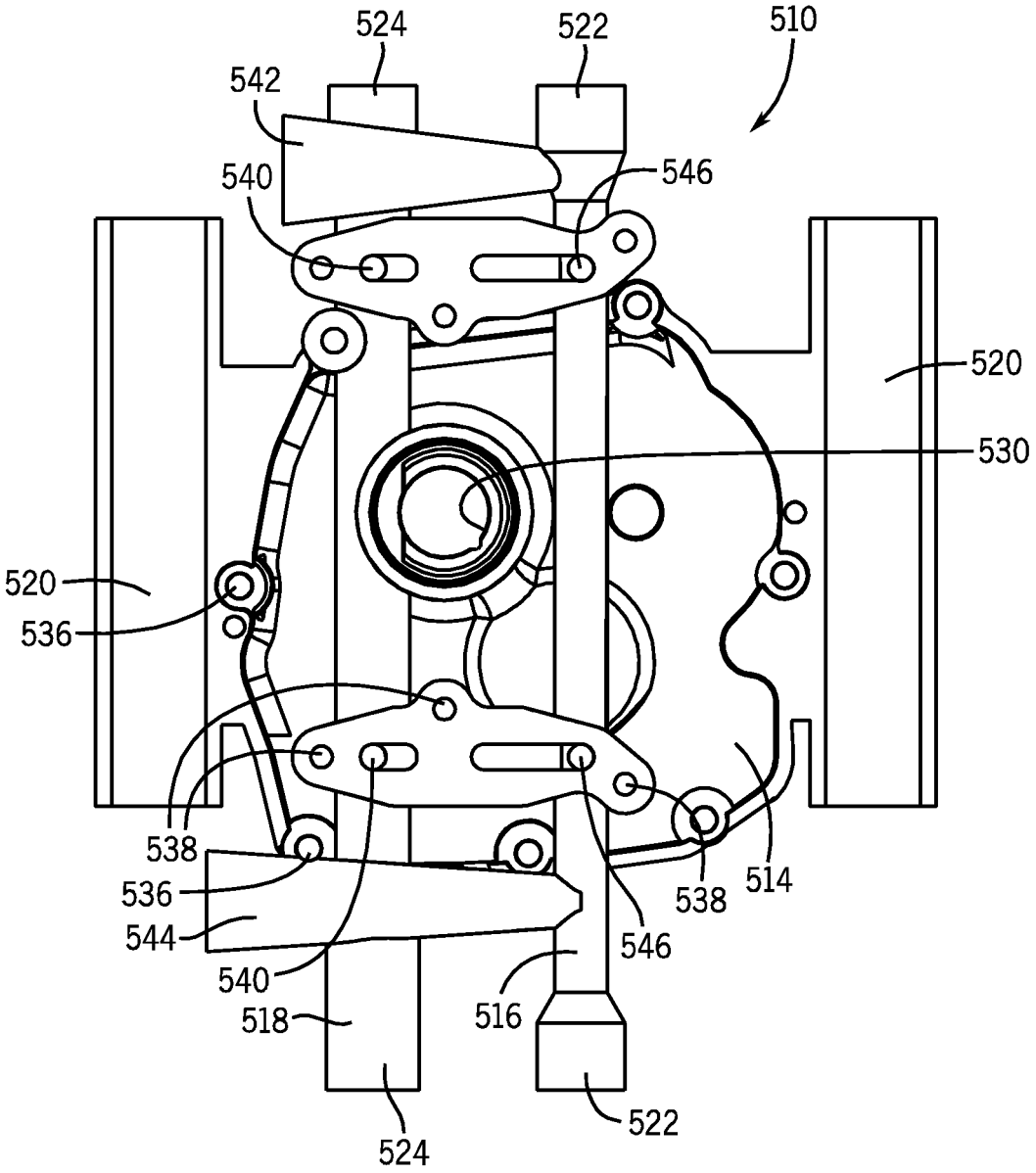
FIG. 7 is a bottom view of the portion of the engine of FIG. 5.

Plumbing within the pump 214 (and other pumps, such as pumps 310, 410, as shown in FIGS. 3-4) may be adjusted as necessary to match the plumbing of the cover 246 (and other covers, such as cover 346, 446). Also, for example, a mold for casting the cover 246 may be adjusted to reconfigure the plumbing in the cover 246 to be compatible with the plumbing of another particular pump. Openings (see, e.g., apertures 540, 546 as shown in FIG. 7) in the inlet and outlet conduits 264, 266, which allow water to flow to and from the pumping mechanism, may be positioned and sized to match inlet and outlet manifolds, pipes, and conduits in the particular pump. Depending upon the configuration of the particular pump, check valves may be added to the openings or the inlet and outlet conduits 264, 266 to control the flow of water. In some embodiments, when the pump 214 is mounted to the cover 246, beveled or threaded mouths of pump pipes may be inserted through openings in the inlet and outlet conduits 264, 266. Connection between the pump 214 and the inlet and outlet conduits 264, 266 may be fitted with rubber seals, liquid sealant, compression sealed, or otherwise sealed.

Water used by the pressure washer system 210 may flow from a source (e.g., faucet, tap, bibcock, spigot, etc.) that is not typically heated, providing the water at temperatures ranging between 40-80 degrees Fahrenheit (F). Conversely lubricant (e.g., motor oil) in the engine 212 is heated during engine 212 operation, and may reach temperatures exceeding 200° F. As such, the water passing through the pump 214 is generally cooler than the lubricant in the engine cover 246. The structure shown in FIG. 2 provides for heat transfer from the engine oil through an interior surface of the conduits 264, 266 and into the water flowing through the pump 214. Accordingly the lubricant is cooled, which may reduce engine running temperatures, improve engine efficiency, and reduce heat-related engine wear.

Referring to FIG. 3, a cover 346 is fastened to a positive displacement pump 310 having a pumping mechanism that includes one, two, three, or more horizontally-arranged pistons 312 (e.g., commercially-available triplex and duplex pumps). The power takeoff 260 (see FIG. 2) of the engine crankshaft 226 may be coupled to a shaft 314 of the pump 310. The pistons 312 are then driven by cams 316 extending from the shaft 314. The pistons 312 of the pump 310 operate on a two-stroke cycle. Water enters a chamber 318 through a fluid passage behind one of the pistons 312 on a first forward stroke. The water then passes a check valve on a reverse stroke. Next the water is pushed out of the chamber 318 by the piston 312 on a second forward stroke. The pump 310 includes a fluid passage or more than one fluid passage. For example, water enters the pump 310 via an inlet conduit 364, passes along a flow path through the pumping mechanism, and exits the pump 310 via an outlet conduit 366.

Referring to FIG. 4, a cover 446 is fastened to a centrifugal pump 410 having a pumping mechanism that includes an impeller 412 (e.g., rotor) spinning about a central shaft 414 within a housing 416. The cover 446 forms the top of the housing 416. According to an exemplary embodiment, the shaft 414 is powered by the engine 212. An inlet conduit 464 directs water through the cover 446 and into the pump 410. The inlet conduit 464 includes a fluid passage that directs the water near the center of the impeller 412. The impeller 412 flings the water to the outside of the housing 416, increasing the water pressure. An outlet conduit 466 connects to the pump 410 via a fluid passage positioned near the outside of the impeller 412. According to an exemplary embodiment, the outlet conduit 446 directs the pressurized water out of the pump 410, through the cover 446, and to the pressure washer sprayer (e.g., spray gun 142 as shown in FIG. 1).

Referring now to FIGS. 5-8, a body 510 (e.g., a portion of an engine crankcase, a top of a pump housing, etc.) includes a base 512 of an engine block (e.g., crankcase 238 as shown in FIG. 2), a top 514 of a pump housing (e.g., pump housing 268 as shown in FIG. 2), attachment supports 520, and fluid passages, such as an inlet pipe 516 and an outlet pipe 518. According to an exemplary embodiment, the body 510 is integrally formed (e.g., a single, unitary body), such as by casting, molding, welding, or other forming methods. In another embodiment, the body 510 is formed from components that are not integral, but are fastened together, such as a top of a pump housing bolted to a base of a crankcase forming a combined body. The body 510 may be formed from discrete parts or a continuous, solid material, such as aluminum, steel, cast iron, ceramic, composite, or other materials.

Figure 5:
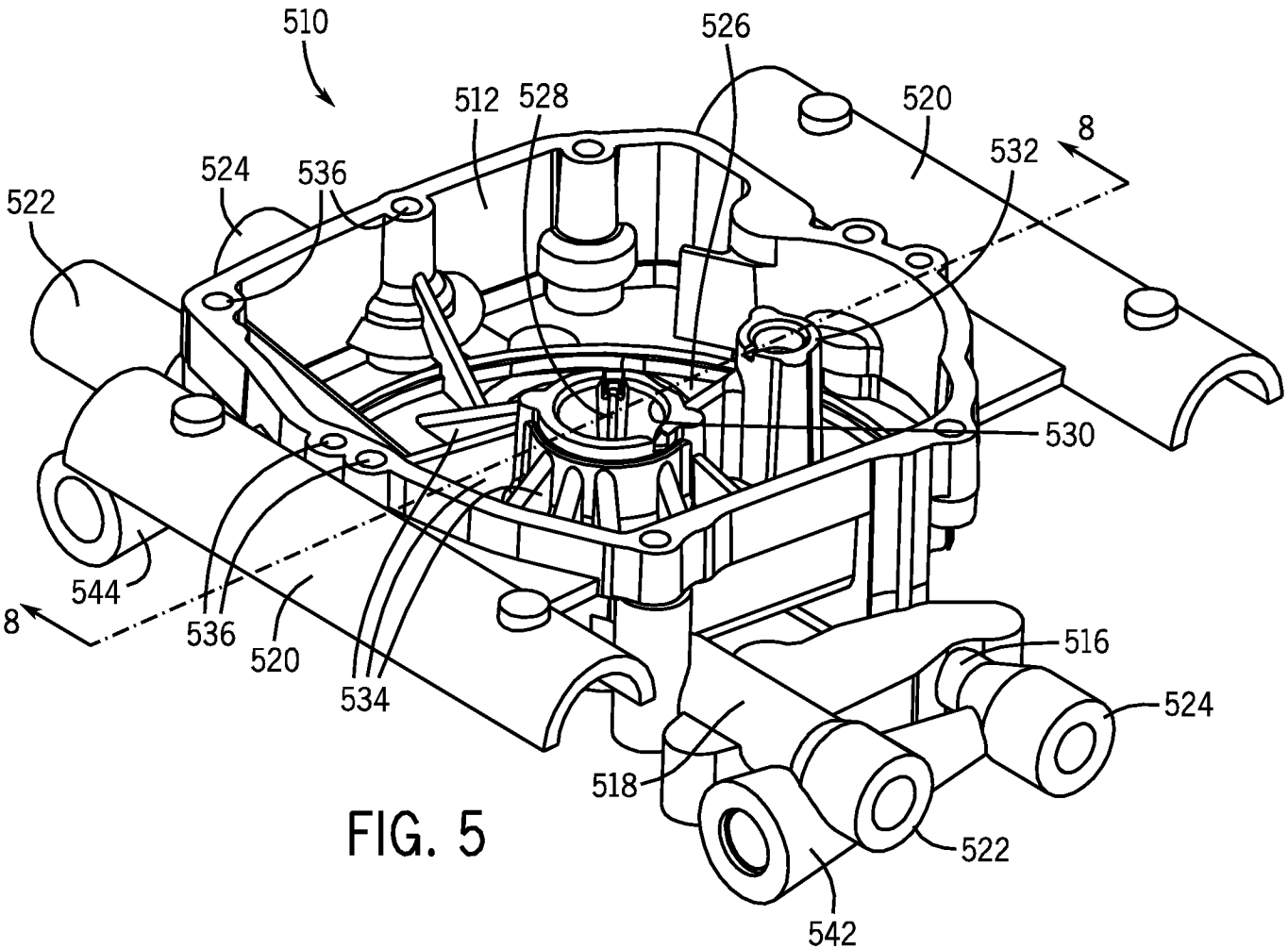
FIG. 5 is a perspective view of a portion of an engine according to an exemplary embodiment of the invention.
Figure 6:
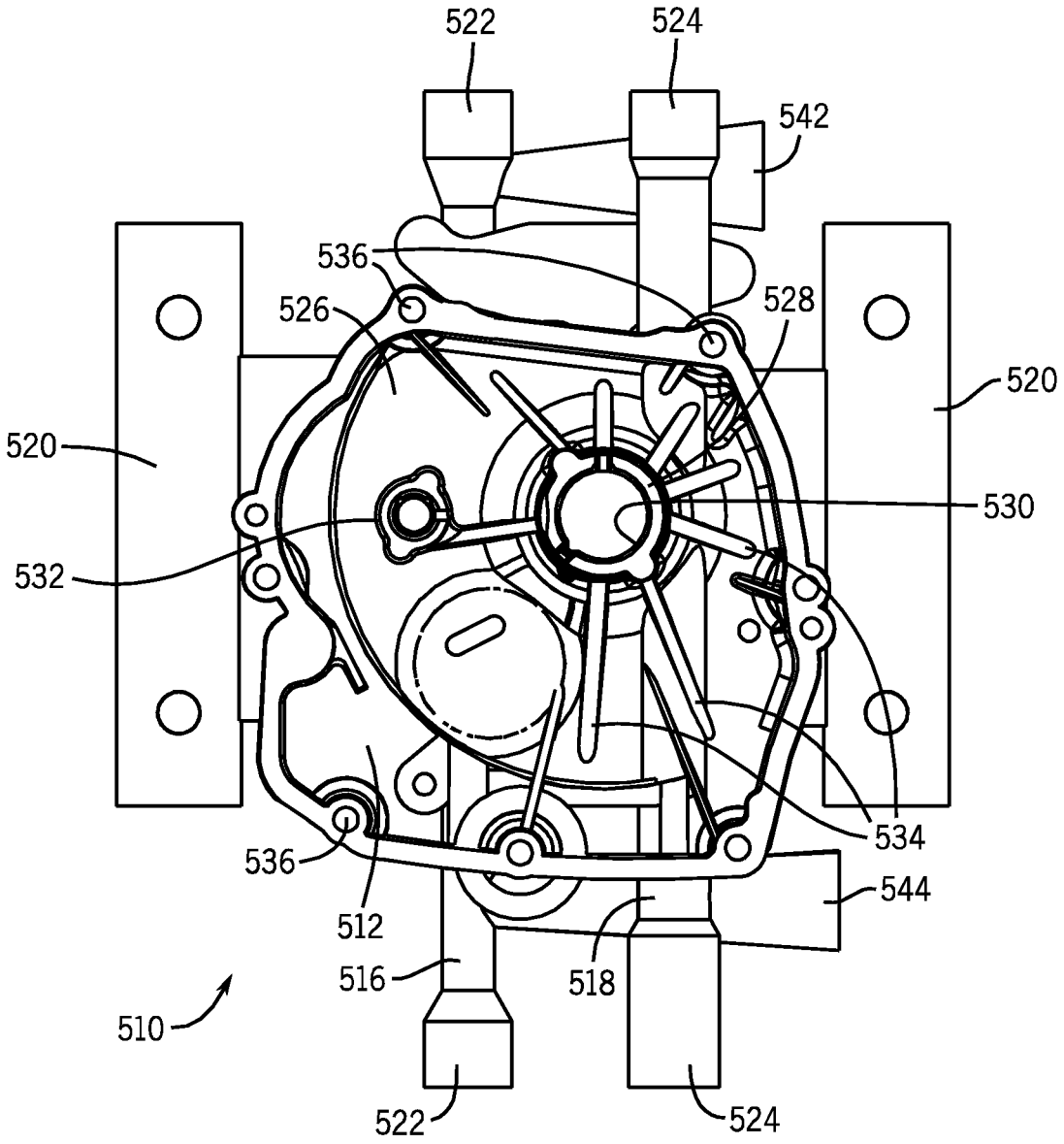
FIG. 6 is a top view of the portion of the engine of FIG. 5.

Referring to FIGS. 5-6, on a first side of the body 510 the base 512 of the engine block includes an oil sump 526 and a bearing 528 for a crankshaft surrounding an opening 530 for a power takeoff (e.g., crankshaft 226 and power takeoff 260 as shown in FIG. 2). In a vertically-shafted engine, the sump 526 may be the cover (e.g., cover 246 as shown in FIG. 2) of the engine block, while in a horizontally-shafted engine (see, e.g., engine 1012 as shown in FIG. 14), the sump may be formed in both a cover and the engine block. On the first side of the body 510, the base 512 also includes a bearing 532 for a camshaft, reinforcement structure 534, mounting holes 536 (e.g., thru-mounting holes, through-mounting holes, etc.) for fastening the base 512 to an upper portion of the crankcase, and other features. In some embodiments, the bearing 528 is a bushing with a seal or a gasket to prevent oil from leaking through the opening 530. In other embodiments, the bearing 528 is a rolling-element bearing (e.g., ball bearing) or another form of friction-reducing support that allows for free rotation of the crankshaft. According to an exemplary embodiment, the oil sump 526 is a recessed area of the base 512 where oil or other lubricant collects and then is distributed throughout the crankcase during engine operation. The mounting holes 536 facilitate bolting of the base 512 to the an upper portion of the engine block.

Figure 8:
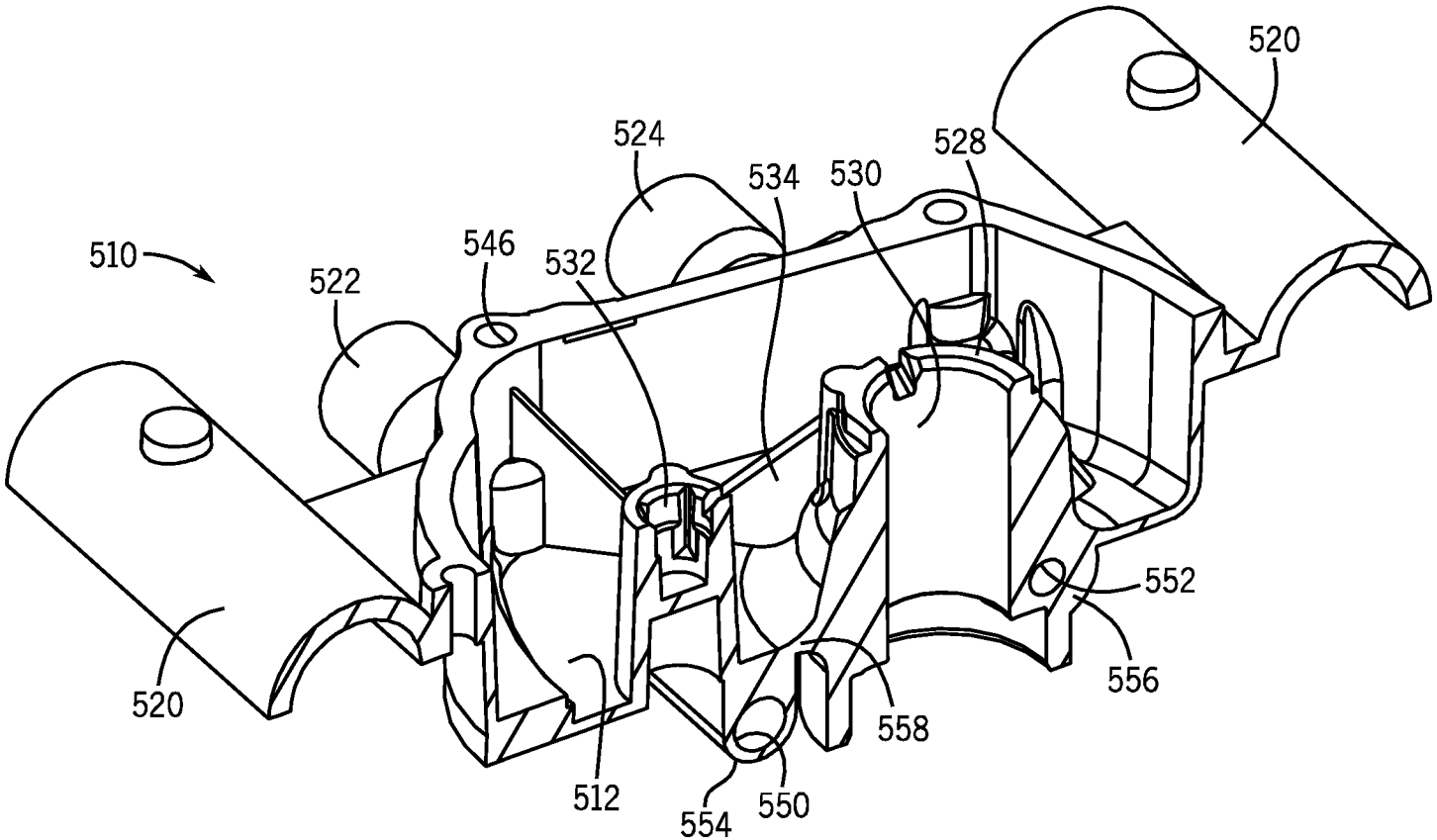
FIG. 8 is a sectional view of the portion of the engine of FIG. 5 taken along line 8-8.

Referring now to FIGS. 7-8, on a second side of the body 510, the top 514 of the pump housing includes the opening 530 for the power takeoff, which couples to a pumping mechanism (e.g., wobble plate 250 and pistons 256 as shown in FIG. 2, cams 316 and pistons 312 as shown in FIG. 3, or impeller 412 as shown in FIG. 4). The top 514 further includes apertures 538 for fastening a lower portion of the pump housing to the top 514, and apertures 540, 546 in the inlet and outlet pipes 516, 518 that direct the water to and from the pumping mechanism. As shown in FIG. 8, the inlet and outlet 522, 524 connect to fluid passages 550, 552 integrally formed in the body 510, with portions of the body 554, 556 forming the walls of the passages 550, 552.

Referring to FIG. 7, the inlet and outlet pipes 516, 518 are coupled to a starter valve 542 and an unloader valve 544. The starter valve 542 allows water entering the inlet pipe 516 to circulate without loading the engine (e.g., engine 212 as shown in FIG. 2), so that the engine may be started without simultaneously driving the pump. After the engine has started, changing water pressure switches a pressure-sensitive valve within the starter valve 542, which automatically allows the pump to be driven by the engine. The unloader valve 544 allows for water passing through the pump to be circulated in a bypass circuit (i.e., loop) within the pump when the pressure washer sprayer (e.g., spray gun 142 as shown in FIG. 1) is off but the engine is running. In other embodiments, the starter valve 542 may include a thermal relief valve, to release hot water generated by circulated water in a bypass circuit.

The attachment supports 520 include half-cylindrical sleeves sized to saddle (i.e., fit over a portion of) tubular rails on a support frame (e.g., support frame 116 as shown in FIG. 1). In other embodiments, there are more than two attachment supports. In some embodiments, the attachment supports have square, oval, or other shaped cross-sections. The attachment supports 520 may be bolted, welded, glued, or otherwise fastened to the rails. In still other embodiments, a base plate or other intermediate member is used to couple the engine or pump to a support frame without the use of attachment supports.

Referring to FIGS. 5-8, the inlet and outlet pipes 516, 518 extend through and from the body 510, and supply water to and from the pump (e.g., pump 114 as shown in FIG. 1). According to an exemplary embodiment, the inlet pipe 516 includes at least one coupling 522, such as male or female quick-connect coupling or threaded coupling for a garden hose (e.g., ¾-inch garden hose, or other sizes). The outlet pipe 518 includes a coupling 524 for a high-pressure water hose (e.g., hose 146 as shown in FIG. 1). In some embodiments, the outlet pipe 518 has a greater wall thickness than the inlet pipe 516 (see, e.g., portions of the body 554, 556 forming the walls of the passages 550, 552 as shown in FIG. 8) because water passing through the inlet pipe 516 may be at a significantly lower pressure (e.g., 40-60 psi) than the water passing through the outlet pipe 518 (e.g., between 1000 to 3000 psi, or more).

According to an exemplary embodiment the inlet and outlet pipes 516, 518 are integrally formed with the base 512, and extend through the sump 526. In other embodiments, the pipes extend along one of the sides of the body 510. In still other embodiments, the lengths of the pipes extend through the open area of the sump, but are spaced apart from the body, where only a portion of the pipes passes through a wall of the body to enter the pump. In some embodiments, each of the pipes 516, 518 has two or more hose couplings 522, 524 (e.g., two openings with treaded or quick connect fittings) providing access to the pipes 516, 518 from different sides of the body 510 (e.g., opposite sides of the body 510), such as the pipe 516 with a first opening on a first side of the body 510 and a second opening on a second side of the body 510, opposite to the first side.

Figure 9:
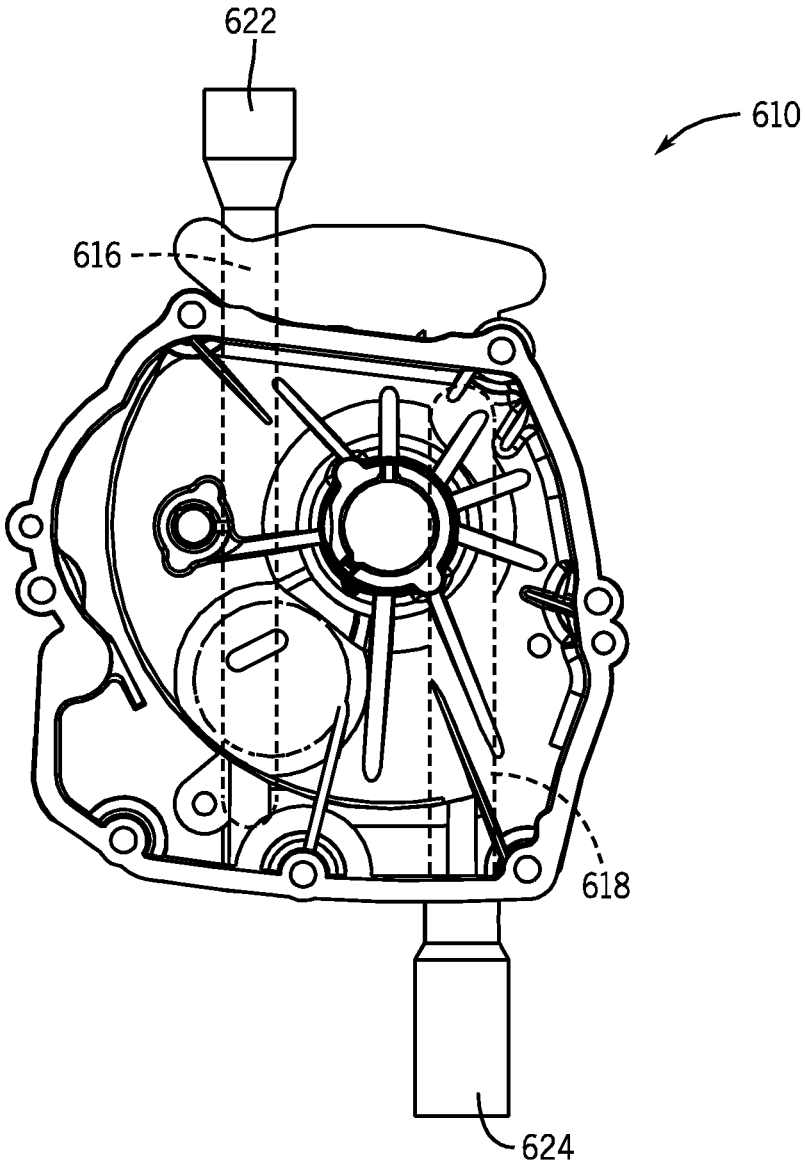
FIG. 9 is a bottom view of a portion of an engine according to another exemplary embodiment of the invention.

Referring to FIG. 9, a body 610, such as a cover for an engine block that is also a top of a pump housing, includes only a single hose coupling 622 for an inlet pipe 616 and only a single hose coupling 624 for an outlet pipe 618. According to an exemplary embodiment, the hose couplings 622, 624 are positioned on opposite sides of the body 610. In some embodiments hose couplings are oriented in perpendicular directions relative to each other, and in other embodiments the hose couplings extend from a body in the same direction and are accessible from the same side. In still other embodiments, only the inlet pipe or only the outlet pipe is integral with the body. The other pipe separately connects to the pump. Some embodiments include multiple inlet or outlet pipes that extend through the body.

Still referring to FIG. 9, the body 610 does not include integrally-formed attachment supports for fastening the body 610 to a support frame. Instead, the body 610 may be fastened to a support frame via an intermediate base plate. In some embodiments, a conventional mounting flange is used to mount the body 610 to a base plate (see, e.g., base plate 1016 as shown in FIG. 14, and base plate 1116 as shown in FIG. 15). For example, the mounting flange may be arranged with mounting holes in accordance with SAE International standards, such as SAE J609b, Surface Vehicle Recommended Practice, as revised in July 2003, which applies to mounting flanges and power take-off shafts for both vertical crankshaft engines (i.e., vertically-shafted) and horizontal crankshaft engine (i.e., horizontally-shafted).

Figure 10:
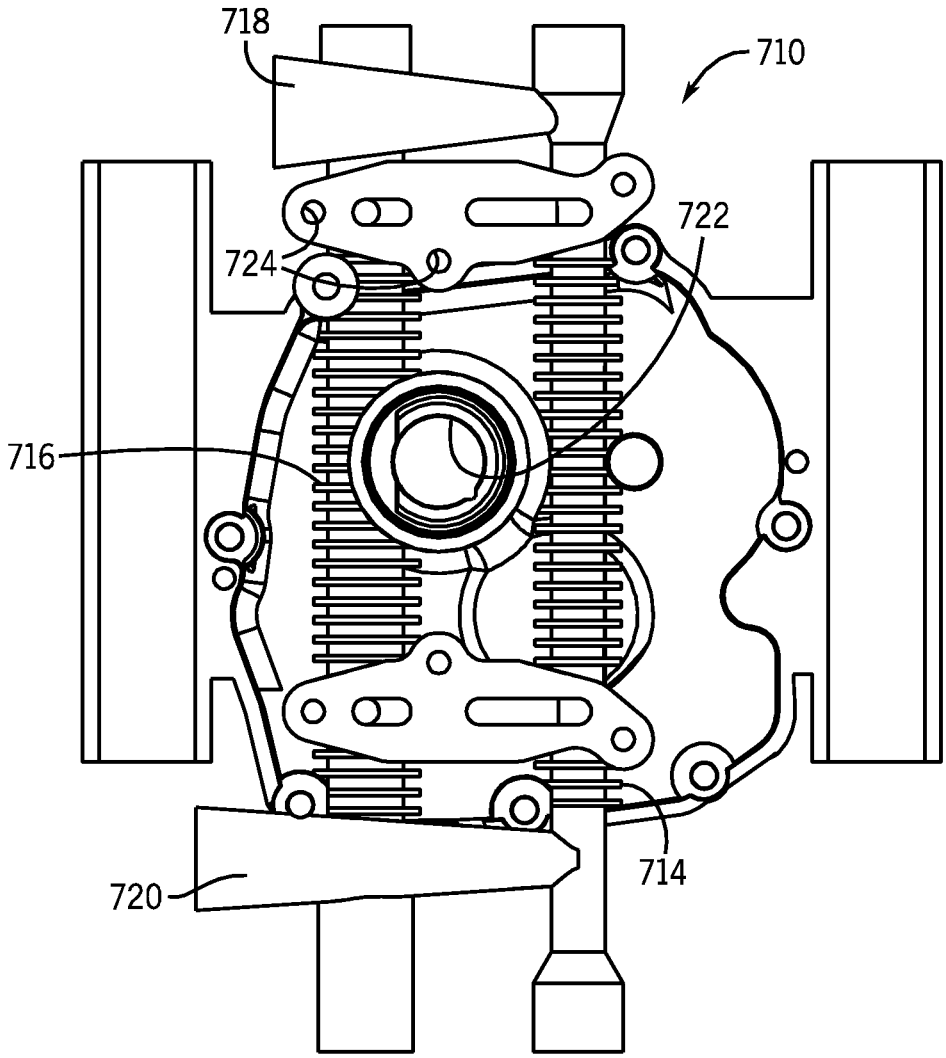
FIG. 10 is a bottom view of a portion of an engine according to yet another exemplary embodiment of the invention.

Referring now to FIG. 10, a body 710 includes a portion of a pump housing having an inlet pipe 714 and an outlet pipe 716 extending through the body 710. The body 710 further includes a starter valve 718 and an unloader valve 720, an opening 722 for a power takeoff of an engine or motor, and apertures 724 for coupling a lower portion of the pump housing to the body 710. The body 710 may also function as a base of a crankcase on an opposite side of the body 710. As the base of the crankcase, the body 710 includes a sump for engine oil (see, e.g., base 512 as shown in FIG. 6). According to an exemplary embodiment, the pipes 714, 716 are coupled to the body 710 such that water passing through the pipes 714, 716 cools oil in the sump.

The inlet and outlet pipes 714, 716 include fins to increase the surface area of the exterior of the pipes 714, 716, increasing heat transfer from the oil to the water. In other embodiments, wall thicknesses of the pipes 714, 716 are reduced to the extent feasible to allow for greater heat transfer. In some embodiments, the pipes 714, 716 are formed from a material having a high thermal conductivity, such as a separate copper pipe (or copper pipe segments) extending through an aluminum body and sump. In other embodiments the pipes 714, 716 have cross-sectional geometries that facilitate heat transfer from the oil to water. For example, in at least one embodiment the pipes have relatively flat cross-sections, providing a wide surface area that is exposed to the bottom of the sump. In these and other embodiments, the pipes may be integrally formed with the body 710, or may be separately formed and coupled to the body 710.

Figure 11:
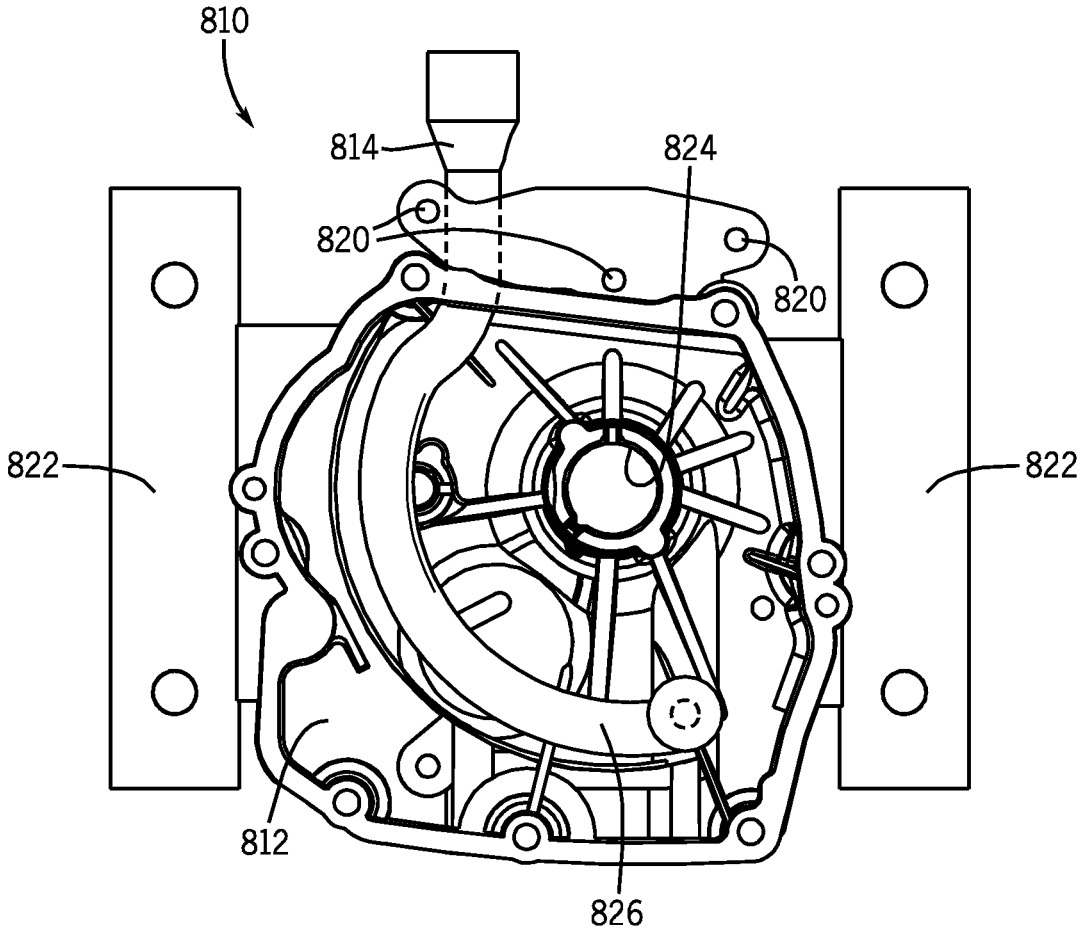
FIG. 11 is a top view of a portion of an engine according to still another exemplary embodiment of the invention.
Figure 12:
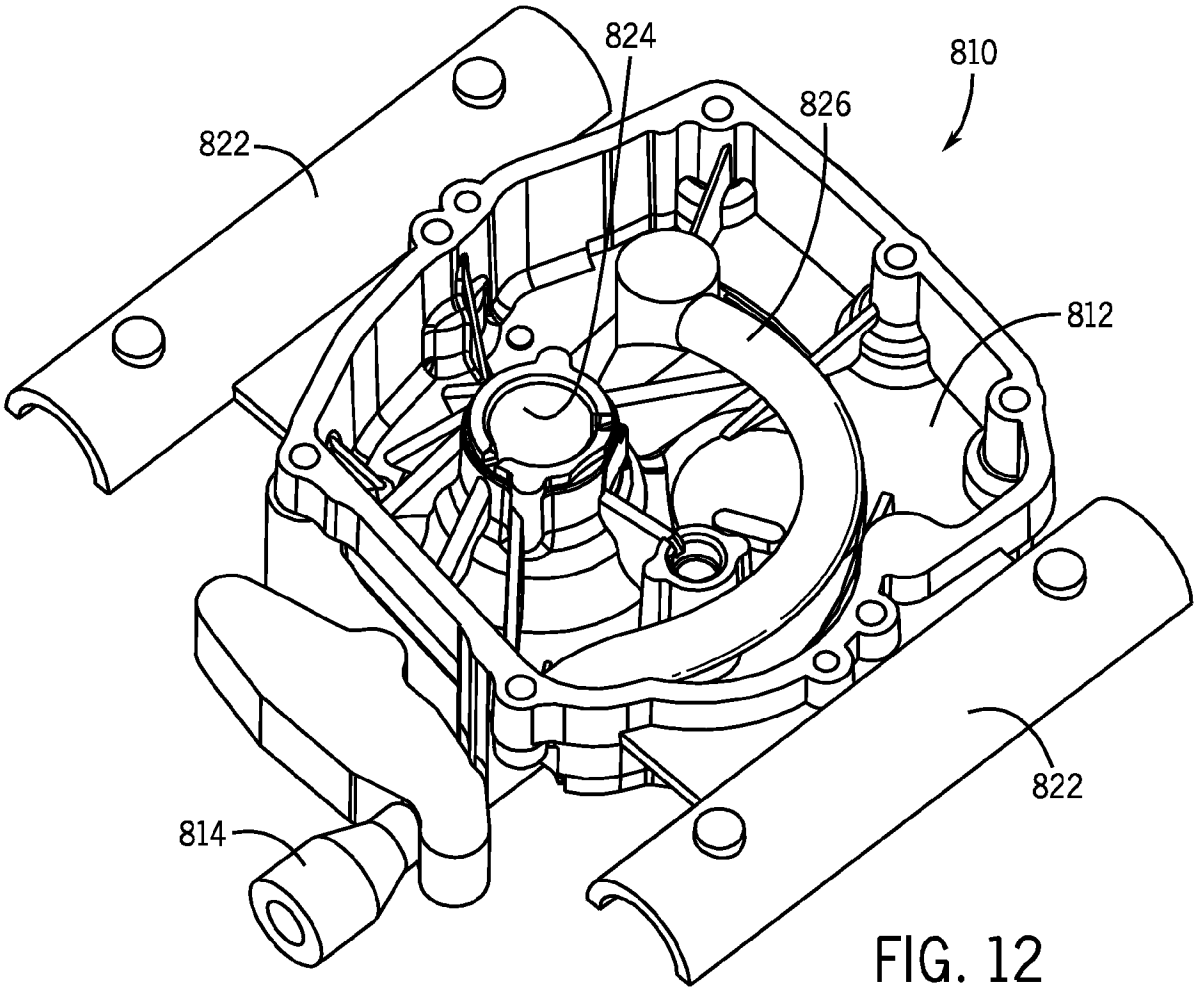
FIG. 12 is a perspective view of the portion of the engine of FIG. 11.

Referring now to FIGS. 11-12, a body 810 may function as a top 812 of a pump housing having an inlet 814 and inlet conduit 826 extending through body 810. The body 810 further includes an opening 824 for a power takeoff of an engine or motor, and apertures 820 for coupling a lower portion of a pump housing to the body 810. The body 810 may also function a base of a crankcase with a sump for engine oil positioned on a side of the body 810 that is opposite to the top 812. According to an exemplary embodiment, the inlet conduit 826 is coupled to the body 810 such that water passing through the inlet conduit 826 cools oil in the sump. The body 810 may be fastened to a support frame with support mountings 822.

The inlet conduit 826 has curvature along the length of the inlet conduit 826, and stretches around the perimeter of the sump. Increased length of the inlet conduit 826 may enhance heat transfer from the oil to the water, relative to shorter inlet pipes, such as the pipe 516 as shown in FIGS. 5-8. In other embodiments, the inlet and outlet conduits have different lengths and curvatures, such as an S-shaped pipe or a C-shaped pipe, etc. that may increase heat transfer from the crankcase oil to water flowing through the pipes.

Figure 13:
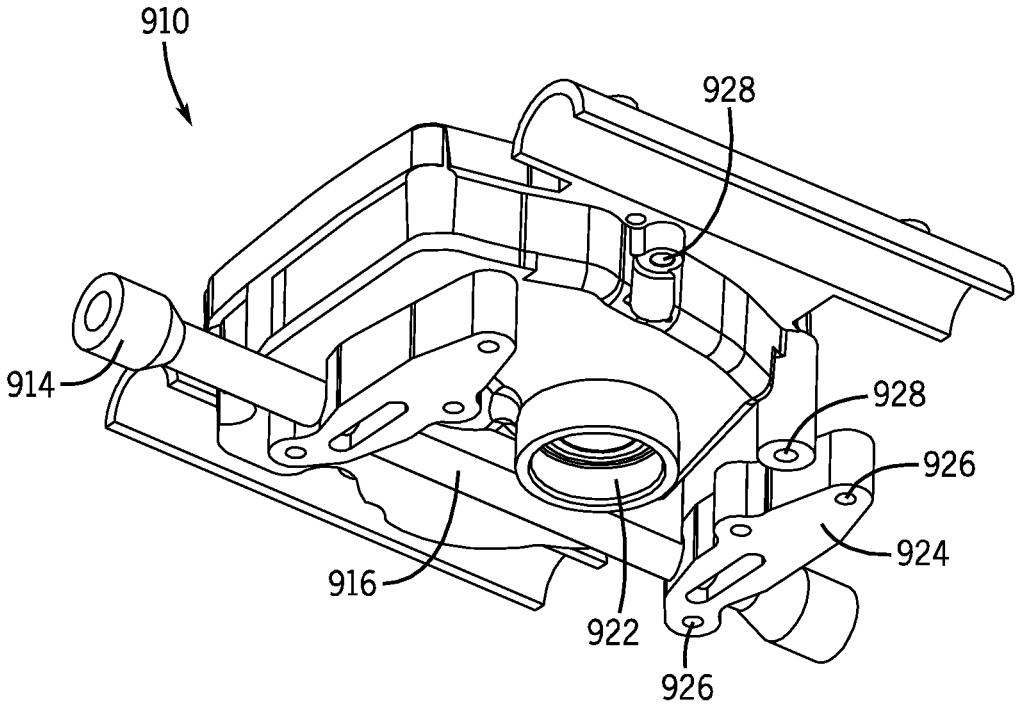
FIG. 13 is a perspective view of a portion of an engine according to another exemplary embodiment of the invention.

Referring now to FIG. 13, a body 910 includes an inlet 914 and an inlet conduit 916 for a high pressure water pump. In some embodiments, the body 910 includes mounting flanges 924 and mounting holes 926 for bolting the body 910 to the water pump. The body 910 also includes mounting holes 928 for bolting the body 910 to an engine block, crankcase, etc. According to an exemplary embodiment, the inlet 914 and inlet conduit 916 are integrally formed with the body 910, and an outlet for the water pump is separately formed and attaches separately to the water pump. The body further includes a power intake port 922, through which a power takeoff of a combustion engine may engage the pump. In other embodiments, the body 910 does not include mounting flanges 924 and mounting holes 926, but does have an inlet conduit (e.g., a hose, a pipe, a tube, etc.) passing through the body 910, which may then be coupled to direct water into a pump that is separate from the body 910.

Referring to FIG. 14, a pressure washer system 1010 includes a support frame 1014, an internal combustion engine 1012, and a water pump 1018. The water pump 1018 is integrated with the engine 1012, which is mounted to a base plate 1016 of the support frame 1014. In some embodiments, the engine 1012 and the pump 1018 share an integral body that forms a portion of the engine block (e.g., a side wall) and a portion of the pump housing (see, e.g., body 510, 610, 710, 810, and 910 as shown in FIGS. 5-13). The engine 1012 is a horizontally-shafted engine that includes an engine block with a sump formed in a base of the engine block.

Referring to FIG. 15, a pressure washer system 1110 includes a support frame 1114, an internal combustion engine 1112, and a water pump 1118. The engine 1112 is a vertically-shafted engine that is mounted to a top side of a base plate 1116, and the pump 1118 is mounted to an underside of the base plate 1116. In some embodiments, the engine 1112 and the pump 1118 share an integral body that forms a portion of the engine block (e.g., a base, a sump, etc.) and a portion of the pump housing (see, e.g., body 510, 610, 710, 810, and 910 as shown in FIGS. 5-13).

The construction and arrangements of the pressure washer pump and engine system, as shown in the various exemplary embodiments, are illustrative only. Although only a few embodiments have been described in detail in this disclosure, many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter described herein. Some elements shown as integrally formed may be constructed of multiple parts or elements, the position of elements may be reversed or otherwise varied, and the nature or number of discrete elements or positions may be altered or varied. The order or sequence of any process, logical algorithm, or method steps may be varied or re-sequenced according to alternative embodiments. Other substitutions, modifications, changes and omissions may also be made in the design, operating conditions and arrangement of the various exemplary embodiments without departing from the scope of the present invention.

What is claimed is:

1. A pump and engine system, comprising:
an internal combustion engine, comprising:
an engine block forming a chamber therein,
a cover for the chamber, the cover comprising an area configured to hold a lubricant, a first surface contacting the lubricant and a second opposite surface, and
a crankshaft within the chamber; and
a water pump mounted to the second surface of the cover, the water pump comprising:
a pumping mechanism powered by the crankshaft,
an inlet through which water enters the water pump,
an outlet through which water exits the water pump, and
a fluid passage between the inlet and the outlet;
wherein a portion of the fluid passage is formed in the cover adjacent to the first surface, the portion of the fluid passage for delivering fluid to the pump, whereby heat transfers from the lubricant to the water in the portion of the fluid passage during operation of the pump and engine system.

2. The pump and engine system of claim 1, wherein a continuous, solid material extends between the area configured to hold the lubricant and the portion of the fluid passage formed in the cover.

3. The pump and engine system of claim 2, wherein the continuous, solid material comprises aluminum.

4. The pump and engine system of claim 3, wherein the portion of the fluid passage formed in the cover comprises an inlet conduit extending between the inlet and the pumping mechanism.

5. The pump and engine system of claim 4, wherein the portion of the fluid passage formed in the cover further includes fins arranged perpendicularly to a flow path of water through the fluid passage, whereby heat transfer between the lubricant and the water is enhanced.

6. The pump and engine system of claim 4, wherein the cover comprises mounting holes extending through the cover, the mounting holes configured to allow the cover to be bolted to the engine block.

7. The pump and engine system of claim 1, wherein the inlet of the water pump is integral with the cover of the internal combustion engine.

8. The pump and engine system of claim 7, wherein the water pump is configured to produce a water stream having an exit pressure greater than 1000 psi.

9. The pump and engine system of claim 8, wherein the inlet comprises a hose coupling configured to connect to a garden hose.

10. The pump and engine system of claim 9, wherein the internal combustion engine is a four cycle, vertically shafted, single-cylinder engine.

11. A pump and engine system, comprising:
an internal combustion engine, comprising:
an engine block forming a chamber,
a cover for the chamber, the cover comprising an area configured to hold a lubricant, a first surface contacting the lubricant and a second opposite surface, and
a crankshaft within the chamber; and
a water pump, comprising:
a pump housing mounted to the second surface of the cover;
a pumping mechanism positioned within the pump housing and powered by the crankshaft,
an inlet through which water enters the water pump,
a first conduit extending between the inlet and the pumping mechanism,
an outlet through which water exits the water pump, and
a second conduit extending between the pumping mechanism and the outlet;
wherein the first conduit of the water pump is formed in the cover adjacent to the first surface such that heat transfers from the lubricant to the water in the first conduit during operation of the pump and engine system.

12. The pump and engine system of claim 11, wherein the first conduit is integral with the cover such that a continuous, solid material extends between the area configured to hold the lubricant and an interior surface of the first conduit.

13. The pump and engine system of claim 12, wherein the continuous, solid material comprises aluminum.

14. The pump and engine system of claim 13, wherein the second conduit of the water pump is integrated into the cover of the internal combustion engine.

15. The pump and engine system of claim 14, wherein the second conduit is integral with the cover.

16. The pump and engine system of claim 15, wherein the water pump is configured to pressurize water to greater than 1000 psi.

17. The pump and engine system of claim 16, wherein the inlet comprises a hose coupling configured to connect to a garden hose.

18. The pump and engine system of claim 17, wherein the internal combustion engine is a four cycle, vertically shafted, single-cylinder engine.

19. The pump and engine system of claim 11, wherein the first conduit is a separate copper pipe fastened to the cover and extending through the area configured to hold the lubricant.

20. A pressure washer system, comprising:
an engine having a crankcase and a cover for the crankcase, wherein the cover is configured to hold a pool of oil for lubricating the engine and the cover includes a first surface contacting the lubricant and a second opposite surface;

a water pump powered by the engine, the water pump having a pump housing mounted to the second surface of the cover, a pumping mechanism positioned within the pump housing, an inlet, an outlet, and at least one fluid passage between the inlet and the outlet; and a spray gun configured to be coupled to the outlet via a hose, wherein a portion of the at least one fluid passage of the water pump is integrally formed with and extends through the cover of the engine adjacent to the first surface to deliver fluid to the water pump, and wherein heat transfers from the lubricant to the water in the portion of the at least one fluid passage during operation of the pressure washer system.

21. The pressure washer system of claim 20, wherein the cover of the engine and the water pump share a wall extending therebetween, wherein the wall is positioned such that water contacts a first side of the wall and oil contacts a second side of the wall during operation of the pressure washer system.

22. The pressure washer system of claim 21, wherein the cover comprises mounting holes extending through the cover, the mounting holes configured to allow the cover to be bolted to the crankcase.

23. The pressure washer system of claim 22, wherein the water pump is configured to produce a water stream having a pressure greater than 1000 psi.

24. The pressure washer system of claim 23, wherein the inlet is a first inlet, and wherein the water pump further includes a second inlet.

25. The pressure washer system of claim 24, wherein the first inlet and the second inlet each comprise a hose coupling configured to be connected to a garden hose.

26. The pressure washer system of claim 25, wherein the first inlet and the second inlet are positioned on opposite sides of the water pump.

27. The pressure washer system of claim 26, wherein the water pump is a positive displacement pump.

28. A pump and engine system, comprising:

an internal combustion engine having a cover in which a sump configured to hold lubricant therein is formed in a first surface of the cover and the cover also has a second opposite surface; and a water pump mounted to the second surface of the cover, the water pump comprising:

a pumping mechanism powered by the engine, an inlet conduit configured to direct water into the pumping mechanism, the inlet conduit formed in the cover adjacent to the first surface, and an outlet conduit configured to direct water away from the pumping mechanism, wherein the sump of the engine and the inlet conduit of the water pump are integrally formed in the cover such that heat transfers from the lubricant to the water in the inlet conduit during operation of the pump and engine system.

29. The pump and engine system of claim 28, wherein the water pump is a positive displacement pump configured to produce a high-pressure water stream having an exit pressure greater than 1000 psi.

30. The pump and engine system of claim 29, wherein the inlet conduit includes fins arranged perpendicularly to a flow path of water flowing through the inlet conduit.

31. The pump and engine system of claim 29, wherein the internal combustion engine is a four cycle, vertically shafted, single-cylinder engine.

32. The pump and engine system of claim 31, wherein the outlet conduit of the water pump and the sump of the engine are integrally formed.

33. The pump and engine system of claim 32, wherein the inlet conduit comprises two openings, each having a hose coupling for attaching a garden hose thereto.

34. The pump and engine system of claim 33, wherein the hose couplings of the inlet conduit are on opposite sides of the water pump.

35. The pump and engine system of claim 32, wherein the outlet conduit comprises two openings, each having a coupling for attaching a high-pressure hose thereto.

36. A pressure washer, comprising:

an engine including a crankcase, a cover including a first surface at least partially defining a sump containing lubricant, the cover also include a second opposite surface, and a crankshaft extending within the crankcase and through the cover;

a water pump including a pump housing coupled to mounted to the second surface of the cover, a pumping mechanism for pumping water contained within the pump housing, a fluid passage fluidly coupled to the pumping mechanism to provide water to the pumping mechanism and an outlet through which water exits the water pump; and a spray gun fluidly coupled to the outlet;

wherein the fluid passage is at least partially formed in the cover adjacent the first surface and proximate the sump such that heat from the lubricant is transferred to the water in the fluid passage adjacent the first surface to cool the lubricant such that the water is both a working fluid and a coolant of the pressure washer.

* * * * *